United States Patent [19]

Wells

[11] Patent Number: 5,056,836

[45] Date of Patent: Oct. 15, 1991

[54] DOOR SECURITY DEVICE

[76] Inventor: Lewis M. Wells, 1103 Alma St., Elkhart, Ind. 46514

[21] Appl. No.: 436,310

[22] Filed: Nov. 14, 1989

[51] Int. Cl.[5] ..... E05C 17/54

[52] U.S. Cl. ..... 292/288; 16/82; 292/339; 292/343; 292/DIG. 15

[58] Field of Search ..... 292/342, 343, 338, 339, 292/DIG. 15, 288; 254/39; 70/94; 16/82

[56] References Cited

U.S. PATENT DOCUMENTS

| | | | |
|---|---|---|---|
| 177,102 | 5/1876 | Daniels . | |
| 423,343 | 3/1890 | Renshaw | 292/343 |
| 550,264 | 11/1895 | Flesch | 292/343 |
| 693,740 | 2/1902 | Raether | 292/343 |
| 800,134 | 9/1905 | Bever | 292/343 |
| 855,961 | 6/1907 | Merring | 292/338 |
| 971,717 | 10/1910 | Bates | 292/343 |
| 1,042,329 | 10/1912 | Daniels | 292/343 |
| 1,392,467 | 10/1921 | Topp | 292/339 |
| 1,545,532 | 7/1925 | Stubbs . | |
| 1,845,829 | 2/1932 | Carnal . | |
| 1,921,568 | 8/1933 | Hasselberger | 292/DIG. 15 X |
| 1,939,402 | 12/1933 | Moser . | |
| 2,376,117 | 5/1945 | Bright et al. . | |
| 2,647,782 | 8/1953 | Fisk . | |
| 2,774,622 | 12/1956 | Priebe | 292/339 |
| 3,124,382 | 3/1964 | Strother . | |
| 3,141,188 | 7/1964 | Gray | 292/338 |
| 3,143,369 | 8/1964 | Adams . | |
| 3,731,341 | 5/1973 | Woodruff | 292/DIG. 15 X |
| 4,142,752 | 3/1979 | Chilton | 292/343 |
| 4,230,353 | 10/1980 | Bjorgum | 292/343 |
| 4,421,348 | 12/1983 | Kahn | 292/DIG. 15 |
| 4,469,359 | 9/1984 | Westbrooks | 292/288 |
| 4,805,948 | 2/1989 | Renzi | 292/342 |
| 4,819,296 | 4/1989 | Wilkins | 292/339 X |

*Primary Examiner*—Lloyd A. Gall

*Attorney, Agent, or Firm*—Barnes & Thornburg

[57] ABSTRACT

A door security device which includes a pair of pivotably connected members with one of the members being provided with a plurality of angularly extending tapered prongs engagable with a carpet or other penetratable floor covering, and the other member including a surface which abuts the door to resist movement of the door. During transportation, the two pivotably connected members can be rotated towards each other and the tapered prongs covered to reduce the risk of injury to individuals handling the device, or damage to garments or other items which may be stored or transported with the device.

31 Claims, 2 Drawing Sheets

DOOR SECURITY DEVICE

BACKGROUND AND SUMMARY OF THE INVENTION

The present invention relates generally to a new and novel door security device. More particularly, the present invention relates to a portable security device which can be utilized to resist movement of a door from a preselected position thereby resisting the entry of, for example, intruders and other unauthorized individuals.

The concept of a security device for a door to resist entry by unauthorized individuals is well-known. Prior art devices have included a variety of door latching mechanisms permanently attached to, or built into the door. Examples of these devices include traditional dead bolt locks, sliding bolt locks and chain locks. Generally, the devices known in the prior art have several disadvantages. Many of these devices have to be integrally installed as part of the door, as is the case of traditional dead bolt locks. Such installation makes the removal and transfer of such devices from one door to another very difficult. Other door latching mechanisms are installed onto the door and/or the surrounding frame by means of fasteners, such as screws or nails, as in the case of sliding bolt locks and chain locks. With these devices the strength of the fastener used often limits the amount of force the door latching mechanism can withstand. These devices also require special tools for installation and removal and are time consuming to move from one door to another. Generally, these devices require that the door be closed or substantially closed for the security device to be operative. Thus, if it is desirable to leave the door partially open, for example to provide ventilation through the door, the security device may be inoperative.

Another concern with traditional door latching mechanisms is that they are often operated by a key or other implement. Thus, authorized individuals must have the appropriate key or implement readily available to unlock, and often lock, such devices. Further, the key or implement may come into the possession of unauthorized individuals, who may utilize the key for unauthorized entry through the door. This risk is particularly great in the case of apartments, or motel and hotel rooms, where numerous individuals have had access and possession of the key or implement to the door latching mechanism.

Other prior art devices have utilized various generally wedge-shaped components to secure a door. Examples of these prior art devices can be seen in U.S. Pat. No. 177,102 to Daniels, U.S. Pat. No. 550,264 to Flesch, U.S. Pat. No. 971,717 to Bates and U.S Pat. No. 4,142,752 to Chitton. Such devices have several disadvantages. Since primary contact between the inclined surface of the wedge and the bottom edge of the door is maintained only along a line contact, a minimal amount of surface area contact is available to resist the force of, for example, an unauthorized individual attempting to push the door open. Further, if the distance between the floor and the bottom of the door exceeds the height of the wedge, such devices will not engage and secure the door. On the other hand, if there is little or no space between the floor and the bottom of the door, as is common on exterior doors with weatherstripping, a wedge-shaped component will not engage with the door until the door is at least partially open. This is often undesirable because it may allow an intruder or other unauthorized individual to partially open a door and look inside the door to determine if, for example, someone is present inside. Also, wedge-shaped devices are normally somewhat bulky, and thus would require additional storage space if utilized by, for example, a traveler in a motel or hotel.

Another prior art device is disclosed in U.S. Pat. No. 423,343 to Renshaw. This device includes two hingedly attached plates and a lip or short plate which engages between the door-sill and the bottom surface of the door. Thus, this device will effectively operate only when the distance between the door-sill and the bottom surface of the door is within a relatively narrow range. Further, this device maintains only one, or possibly two line contacts between the door securer and the door and thus, a minimal amount of surface area contact is available to resist the force of, for example, an intruder or other unauthorized individual attempting to push the door open.

Accordingly, an object of the present invention is the provision of a portable door security device which is convertible into a compact configuration, and which can be readily transported in a suitcase or other travel bag without damaging garments or other delicate articles.

Another object of the present invention is to provide a door security device which requires no key or other independent implement to operate.

A further object of the present invention is to provide a door security device which maintains area contact with the door and which will effectively operate over a wide range of floor to bottom of the door distances.

A still further object of the present invention is to provide a door security device which is capable of securing a door in the closed position, or alternatively, securing the door in a wide range of partially opened positions.

Still a further object of the present invention is to provide a door security device which does not require independent tools to install or remove.

These and other objects of the present invention are attained by the provision of a door security device which includes a pair of pivotably connected members with one of the members being provided with a plurality of angularly extending tapered prongs engagable with a carpet or other penetratable floor covering, and the other member including a surface which abuts the door to resist movement of the door. During transportation, the two pivotably connected members can be rotated towards each other and the tapered prongs covered to reduce the risk of injury to individuals handling the device, or damage to garments or other items which may be stored or transported with the device. Thus, an individual traveling, or living in a home or apartment, can readily transport the door security device in a suitcase or other travel bag, and once having obtained entry into a room, can place the door security device against the inner surface of the door and engage the carpet, thereby resisting the opening of the door even if the door lock is inoperative, disengaged, or unlocked by an unauthorized individual having a key.

Other objects, advantages and novel features of the present invention will become apparent from the following detailed description of preferred embodiments of the invention when considered in conjunction with the accompanying drawings.

DETAILED DESCRIPTION OF THE DRAWINGS

Figure 1:
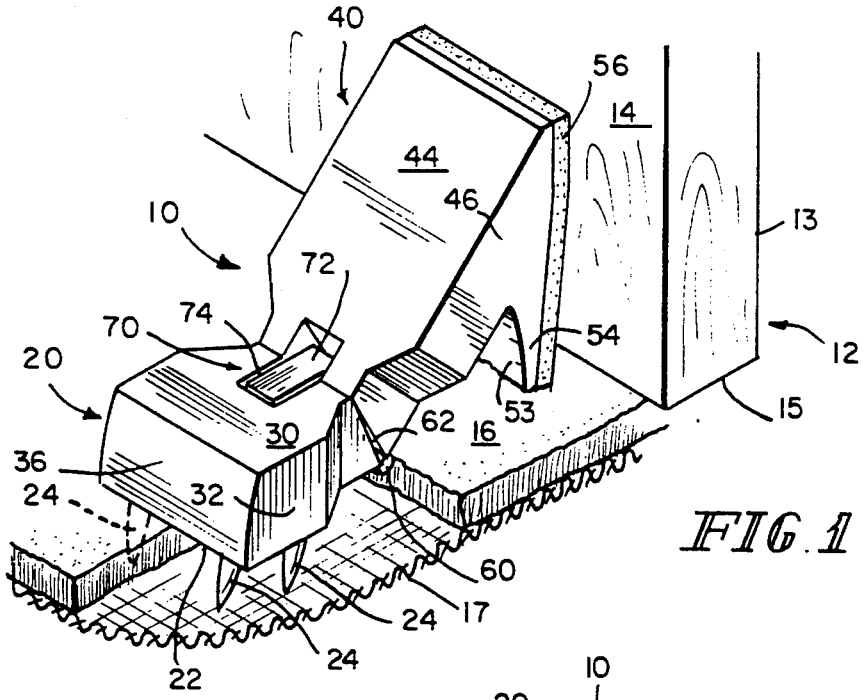
FIG. 1 is a perspective view of a preferred embodiment of a door security device according to the present invention abutting against a door and engaging with a carpet.
Figure 3:
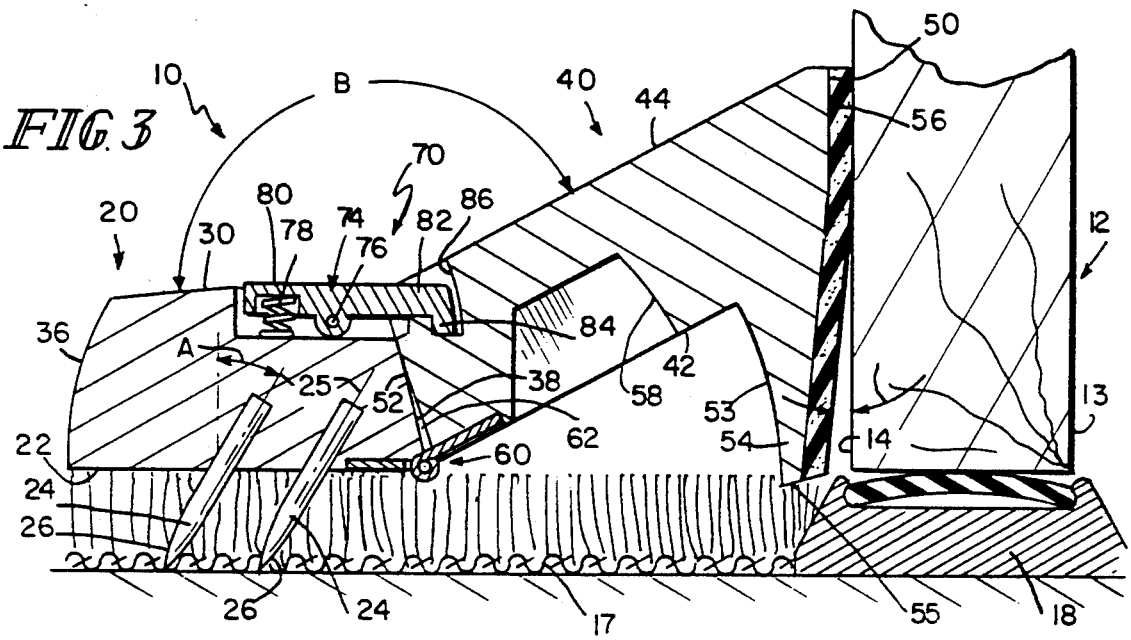
FIG. 3 is a longitudinal cross-sectional view taken across lines 3—3 in FIG. 2 with the door security device abutting against the door and engaging the carpet.

Referring now to the drawings, in which like referenced characters indicate corresponding elements throughout the several views, attention is first directed to FIGS. 1 and 3, which illustrate a preferred embodiment of a door security device in its open position, designated generally by the number 10, abutting door 12 and engaging with carpet or other penetratable floor covering 16 to resist movement of door 12 from a predetermined position. Door security device 10 generally includes floor engaging member 20 and door abutting member 40 pivotably connected by hinge 60.

Figure 2:
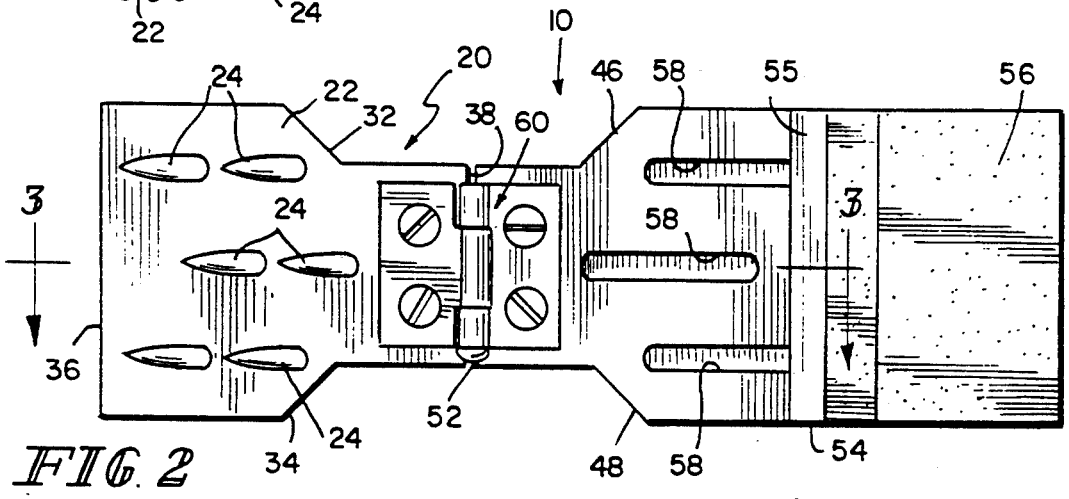
FIG. 2 is a bottom view of the preferred embodiment of the door security device shown in FIG. 1.

Floor engaging member 20 includes bottom surface 22, top surface 30, side surfaces 32 and 34, and end surfaces 36 and 38. As seen more clearly in FIG. 2, a plurality of prongs 24 are mounted in bottom surface 22 of floor engaging member 20. Prongs 24 are preferably fabricated from steel and include extending tapered portion 26. Prongs 24 can also be fabricated from other materials, such as other metals or plastics, although it is normally desireable to select a strong, durable material. In the preferred embodiment shown, prongs 24 are installed in bottom surface 22 with longitudinal axis 25 of prongs 24 extending at an angle of less than 90 degrees from a vertical axis perpendicular to bottom surface 22. Longitudinal axis 25 is preferably angled such that extending tapered portion 26 extends rearwardly from the intersection between bottom surface 22 and prong 24. Such an angular orientation tends to further engage prongs 24 in carpet or other penetratable floor covering 16 and underlying carpet padding 17 as force is applied to the outer surface 13 of door 12. Angular orientation A is preferably between 10 degrees and 40 degrees from vertical and most preferably between 20 degrees and 30 degrees from vertical as shown in FIG. 3.

Prongs 24 of floor engaging member 20 will readily penetrate carpet, as well as other penetratable floor coverings such as linoleum, and other soft plywood or wood coverings. It should be recognized that prongs 24 may penetrate and permanently damage floor coverings such as linoleum, plywood and other wood floors, and even carpet if excessive force is placed on outer surface 13 of door 12. However, under normal use, particularly on carpeted surfaces, no or minimal damage to the floor covering is incurred by the use of door security device 10. Hard floors, such as concrete, are not normally penetrated by prongs 24, and therefore, when used on these surfaces, floor engaging member 20 will not engage with the floor. Some protection can be provided by replacing prongs 24 with a layer of resilient, adherent material, such as rubber, on bottom surface 22 of floor engaging member 20. The coefficient of friction between the layer on bottom surface 22 of floor engaging member 20 and the floor will resist the movement of door 12, but the risk of floor engaging member 20 sliding along the floor will generally be greater than when utilizing angularly extending prongs 24 engaging with carpet or other penetratable floor covering 16.

The configuration of top surface 30, side surfaces 32 and 34, and end surfaces 36 and 38 can generally be selected as desired to provide an attractive outward appearance. Side surfaces 32 and 34 and end surfaces 36 and 38 must be sufficient in height to allow the mounting of prongs 24 therein. Also, in the preferred embodiment shown, side surfaces 32 and 34 are tapered inwardly towards door abutting member 40 resulting in end surface 36 being wider than end surface 38. It will be obvious to those skilled in the relevant art that side surfaces 32 and 34 of other configurations can be readily utilized to accommodate top surface 30 of a rectangular or some other desired shape.

Door abutting member 40 includes bottom surface 42, top surface 44, side surfaces 46 and 48, and end surfaces 50 and 52. End surface 50 preferably includes downwardly extending leg 54 which, when door security device 10 is used to secure door 12, rests on carpet or other penetratable floor covering 16. Base 55 of downwardly extending leg 54 preferably extends away from inner surface 14 of door 12 to provide clearance for weatherstripping or other decorative objects mounted on inner surface 14 of door 12 near bottom surface 15. Also, downwardly extending leg provides contact between end surface 50 of door abutting member 40 and inner surface 14 of door 12 at a location above the contact between end surface 52 of door abutting member 40 and end surface 38 of floor engaging member 20. Such an orientation transmits the force from door 12 downwardly through door security device 10 and thus tends to more securely engage prongs 24 in carpet or other penetratable floor covering 16.

End surface 50 also preferably includes layer 56 of a resilient adherent material, such as rubber, which increases the coefficient of friction between door abutting member 40 and inner surface 14 of door 12 thus, increasing the "gripping" ability of door abutting member 40 on inner surface 14 of door 12 Layer 56 may be attached to end surface 50 by means of an adhesive bond, or, alternatively, a rubberized material can be directly coated on end surface 50.

The angular orientation B of top surface 44 is preferably selected such that end surface 50 abuts inner surface 14 of door 12 above bottom surface 15 as shown in FIG. 3. Such an orientation provides at least two advantages. First, door security device may be utilized on doors with a wide range of distances between carpet or other penetratable floor covering 16 or door-sill 18 and bottom surface 15 of prior 12. Secondly, any force on outer surface 13 of door 12 is transferred at a downward angle along top surface 44 of door abutting member 40, thus forcing prongs 24 to further engage into carpet or other penetratable floor covering 16. The angular relationship between end surface 50 of door abutting member 40 and end surface 52 of door abutting member 40 is maintained such that when end surface 52 of door abutting member 40 contacts end surface 38 of floor engaging member 20, end surface 50 of door abutting member 40 is parallel to inner surface 14 of door 12, thus resulting in area contact between end surface 50 of door abutting member 40 and inner surface 14 of door 12.

Floor engaging member 20 and door abutting member 40 can be fabricated from any durable material, for example, wood, metals such as steel or aluminum, or plastic. Also, the physical size of door security device 10 can be modified depending on the desired use. For example, door security device 10 can be made larger to resist more force by increasing the size and number of prongs 24 and the perpendicular contact area of end surface 50 of door abutting member 40 against inner surface 14 of door 16. Conversely, it may be desirable to utilize a smaller version of door security device 10 when traveling to provide additional protection in motel and/or hotel rooms, while maintaining a relatively compact size for easy transportability in a suitcase or other travel bag. Experience has shown that, as a general rule, the greater the length of door security device 10, the smaller the appropriate angle between end surface 38 of floor engaging member 20 and end surface 52 of door abutting member 40. However, the appropriate angle for a desired size and configuration can be readily determined by one skilled in the relevant art without undue effort or experimentation.

Floor engaging member 20 and door abutting member 40 are preferably pivotably connected by hinge 60. Preferably, hinge 60 is mounted on bottom surface 22 of floor engaging member 20 and on bottom surface 42 of door abutting member 40. Hinge 60 preferably provides a gap or space 62 between bottom surface 22 of floor engaging member 20 and bottom surface 42 of door abutting member 40 when top surface 30 of floor engaging member 20 contacts top surface 44 of door abutting member 40. This results in line contact between door abutting member 40 and floor engaging member 20 and thus any force present on outer surface 13 of door 12 is transferred through top surface 44 of door abutting member 40 into floor engaging member 20, tending to force prongs 24 to engage more securely with carpet or other penetratable floor covering 16.

Figure 4:
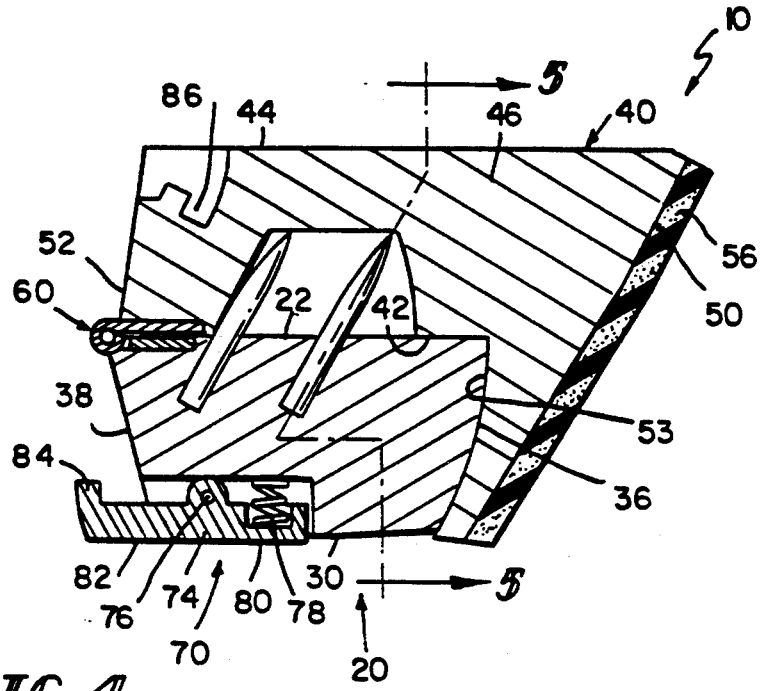
FIG. 4 is a side elevational view of the preferred embodiment of the door security device shown in FIG. 1 folded up in its compact configuration for transportation or storage and portions of the drawing are cut away for purposes of illustration.
Figure 5:
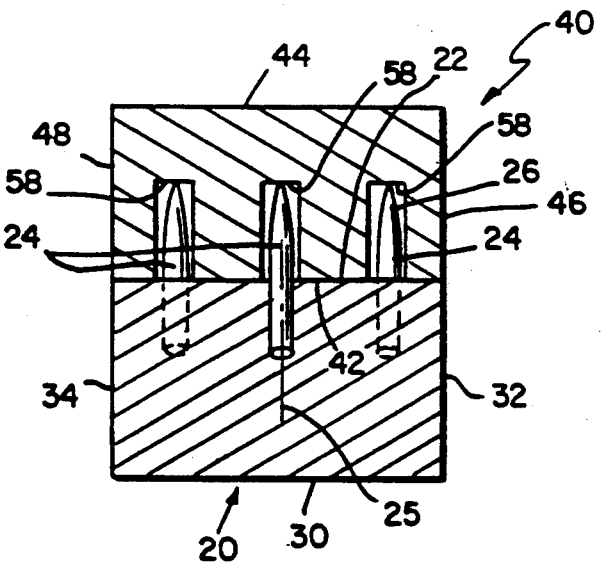
FIG. 5 is a transverse cross-sectional view taken across lines 5—5 in FIG. 4.

In certain preferred embodiments, bottom surface 42 of door abutting member 40 includes a plurality of openings 58 which correspond to the position of prongs 24 extending from bottom surface 22 of floor engaging member 20. As shown in FIGS. 4 and 5, door abutting member 40 and floor engaging member 20 can be pivoted around hinge 60 so that openings 58 cover and surround prongs 24 resulting in a compact closed configuration. When closed, door security device 10 is capable of being transported in a suitcase or other travel bag among garments or other articles without any extending sharp protrusions. This allows door security device 10 to be handled and transported while minimizing the risk of injury or the possibility of damaging garments or other articles.

It is possible to dimension end surface 36 of floor engaging member 20 and the side surface 53 of downwardly extending leg 54 such that a slight interference results when door security device is in its compact closed configuration. Such interference will assist in maintaining door security device 10 in the compact closed configuration. Also, an independent method of maintaining door security device 10 in the compact closed configuration may be utilized, for example, a pivotable hook which engages a pin may be mounted on side surfaces 32 or 34 of floor engaging member 20 and side surfaces 46 or 48 of door abutting member 40.

If desired, locking mechanism 70 can be utilized to secure door security device 10 in its open configuration. Locking mechanism 70 can be particularly useful if for example, due to a protrusion or other contact between door 12 and downwardly extending leg 54, door abutting member 40 is caused to rotate around hinge 60, thus reducing the effectiveness of door security device 10 in maintaining door 12 in its preselected position.

In the preferred embodiment shown, locking mechanism 70 is mounted in opening 72 on top surface 30 of floor engaging member 20, and includes lever component 74 pivotable about pin 76. Spring is positioned under release arm 80 of lever component 74. Retention arm 82 includes protrusion or hook-like portion 84 which engages with groove 86 in top surface 44 of door abutting member 40 to secure door security device 10 in its open configuration. It will be readily recognized by those skilled in the relevant art that lever component 74 may, alternatively, be mounted on door abutting member 40, and engage with groove 86 in floor engaging member 20, or some alternate locking mechanism could be utilized.

To install door security device 10, floor engaging member 20 and door abutting member 40 are rotated about hinge 60 and locking mechanism 70 secures door security device 10 in its open configuration. Bottom surface 22 of floor engaging member 20 and bottom surface 42 of door abutting member 40 are then positioned downwardly on carpet or other penetratable floor covering 16. With door 12 in its predetermined position, door security device 10 is moved horizontally towards inner surface 14 of door 12 until layer 56 contacts with inner surface 14 of door 12. Once this contact is established, door security device 10 can be pushed downwardly and in a direction horizontally away from inner surface 14 of door 12 to engage prongs 24 in carpet or other penetratable floor covering 16. In this position, door security device 10 will resist further inward movement of door 12.

To remove door security device 10, door abutting member 40 is pulled vertically away from floor or other penetratable floor covering 16, thus disengaging prongs 24. Once removed, release arm 80 can be pushed downward thus overcoming the force of spring 78 and, disengaging locking mechanism 70. Floor engaging member 20 and door abutting member 40 can then be pivoted around hinge 60 to convert door security device 10 into its compact closed position for storage or travel.

From the preceding description of the preferred embodiment, it is evident that the objects of the invention are attained by the present invention. Although this invention has been described and illustrated in detail, it is to be clearly understood that the same is by way of illustration and example only and is not to be taken by way of limitation. For example, floor engaging member 20 and prongs 24 could be molded or machined as a single piece or, alternatively, the entire door security device 10 could be molded or machined as a single integral unit. Therefore, the spirit and scope of this invention are to be limited only by the terms of the appended claims.

What is claimed is:

1. A door security device, comprising:

a floor engaging member including a first end and a bottom surface;

at least one prong extending from said bottom surface of said floor engaging member;

a door abutting member including a first end, a second end and a bottom surface;

said bottom surface of said door abutting member having at least one opening corresponding to said at least one prong; and said floor engaging member and said door abutting member are pivotaably connected such that when said floor engaging member and said door abutting member are rotated towards each other, said at least one opening in said bottoms surface of said door abutting member covers and surrounds said at least one prong extending from said bottom surface of said floor engaging member.

2. The door security device of claim 1, wherein said at least one prong includes a tapered portion and said tapered portion extends downwardly away from said bottom surface of said floor engaging member and rearwardly away from said door abutting member at an angular orientation between a vertical axis perpendicular to said bottom surface of said floor ending member and a longitudinal axis of said tapered portion of said at lest one prong of less than ninety degrees.

3. The door security device of claim 2, wherein said angular orientation between said vertical axis perpendicular to said bottom surface of said floor engaging member and said longitudinal axis of said tapered portion of said at least one prong is between twenty and thirty degrees.

4. The door security device of claim 3, wherein said first end of said floor engaging member and said first end of said door abutting member are pivotably connected by a hinge.

5. The door security device of claim 4, wherein said pivotably hinge is mounted on said bottom surface of said floor engaging member and on said bottom surface of said door abutting member.

6. The door security device of claim 5, wherein said second end of said door abutting member includes a layer of resilient, adherent material.

7. The door security device of claim 6, wherein said second end of said door abutting member is substantially parallel to said door to make area contact with said door.

8. The door security device of claim 7, wherein said door abutting member includes a leg downwardly extending from said bottom surface of said door abutting member, said leg extending away from said door, thus, preventing contact between said leg and said door.

9. The door security device of claim 8, further including a locking means for securing said door security device in an open configuration.

10. A door security device comprising:

a floor engaging member including a first end and a bottom surface;

a plurality of prongs extending from said bottom surface of said floor engaging member;

a door abutting member including a first end, a second end and a bottom surface;

said bottom surface e of said door abutting member having a plurality of openings corresponding to said plurality of prongs;

said floor engaging member and said door abutting member are pivotably connected such that when such floor engaging member and said door abutting member are rotated towards each other, said plurality of openings in said bottom surface of said door abutting member covers and surrounds said plurality of prongs extending from said bottom surface of said floor engaging member.

11. The door security device of claim 10, wherein said plurality of prongs each include a tapered portion and said tapered portion extends downwardly away from said bottom surface of said floor engaging member and rearwardly away fromsaid door abutting member at an angular orientation between a vertical axis perpendicular to said bottom surface of said floor engaging member and a longitudinal axis of said tapered portion of said prongs of less than ninety degrees.

12. The door security device of claim 11 wherein said angular orientation between said vertical axis perpendicular to said bottom surface of said floor engaging member and said longitudinal axis of said tapered portion of said prongs is between twenty and thirty degrees.

13. The door security device of claim 12, wherein said first end of said floor engaging member and said first end of said door abutting member are pivotably connected by a hinge.

14. The door security device of claim 13, wherein said pivotable hinge is mounted on said bottom surface of said floor engaging member and on said bottom surface of said door abutting member.

15. The door security device of claim 14, wherein said second end of said door abutting member includes a layer of resilient, adherent material.

16. The door security device of claim 15, wherein said second end of said door abutting member is substantially parallel to said door to make area contact with said door.

17. The door security device of claim 16, wherein said door abutting member includes a leg downwardly extending from said bottom surface of said door abutting member, said leg extending away from said door, thus preventing contact between said leg and said door.

18. The door security device of claim 17, further including a locking means for securing said door security device in an open configuration.

19. A door security device, comprising:

a floor engaging member including a first means for retaining said floor engaging member in a predetermined position in relation to a floor, said floor engaging member having a first end;

a door abutting member having a second means for engaging a door, said door abutting member having a first end and a bottom surface;

said floor engaging member and said door abutting member are pivotably connected such that gap exists adjacent said pivotal connection between said floor engaging member and said floor abutting member while simultaneously said first end of said floor engaging member and said first end of said door abutting member contact above said gap;

said first means includes a plurality of prongs extending downwardly from a bottom surface of said floor engaging member; and said door abutting member includes at least one opening corresponding to said plurality of prongs, and said prongs are covered and surrounded by said at lest one opening when said floor engaging member and said door abutting member are pivoted towards each other resulting in a a closed compact configuration without extending protrusions.

20. The door security device of claim 19, wherein said plurality of prongs extend downwardly fromsaid bottom surface of said floor engaging member and rearwardly away fromsaid door abutting ember at an angular orientation between a vertical axis perpendicular to said bottom surface of said floor engaging member and a longitudinal axis of said prongs of less than ninety degrees.

21. The door security device of claim 20, wherein said angular orientation between said vertical axis perpendicular to said bottom surface of said floor engaging member and said longitudinal axis of said prongs is between ten degrees and forty degrees.

22. The door security device of claim 20, wherein said angular orientation between said vertical axis perpendicular to said bottom surface of said floor engaging member and said longitudinal axis of said prongs is between twenty and thirty degrees.

23. The door security device of claim 19, wherein each of said plurality of prongs includes a tapered portion which extends fromsaid bottom surface of said floor engaging member.

24. The door security device of claim 19, wherein said bottom surface of said door abutting member and said bottom surface of said floor engaging member are connected by a pivotable hinge.

25. The door security device of claim 19, wherein a second end of said door abutting member includes a layer of resilient, adherent material.

26. The door security device of claim 25, wherein said resilient, adherent material is rubber.

27. The door security device of claim 19, wherein a second end of said door abutting member is substantially parallel to said door to provide area contact with said door.

28. The door security device of claim 19, further including a locking means for securing said door security device in said closed compact configuration.

29. The door security device of claim 28, wherein said locking means results from interference between a second end of said floor engaging member and a leg extending downwardly from said bottom surface of said door abutting member.

30. The door security device of claim 19, wherein said door abutting member includes a leg downwardly extending from a bottom surface of said door abutting member, said leg extending away fromsaid door, thus preventing contact between said leg and said door.

31. The door security device of claim 19, further including a locking means for securing said door security device in an open configuration.

* * * * *

UNITED STATES PATENT AND TRADEMARK OFFICE
CERTIFICATE OF CORRECTION

PATENT NO. : 5,056,836

DATED : October 15, 1991

INVENTOR(S) : Lewis M. Wells

It is certified that error appears in the above-identified patent and that said Letters Patent is hereby corrected as shown below:

Column 6, line 14, please insert --78-- after "Spring".

In the Claims, claim 1, at column 7, line 9, please delete "pivotaably" and insert -- pivotably -- therefor.

In the Claims, claim 1, at column 7, line 12, please delete "bottoms" and insert -- bottom -- therefor.

In the Claims, claim 2, at column 7, line 24, please delete "lest" and insert -- least -- therefor.

In the Claims, claim 5, at column 7, line 36, please delete "pivotably" and insert -- pivotable -- therefor.

In the Claims, claim 10, at column 7, line 54, please insert -- , -- after "device".

In the Claims, claim 10, at column 7, line 61, please delete "e" after "surface".

In the Claims, claim 11, at column 8, line 8, please delete "fromsaid" and insert -- from said -- therefor.

In the Claims, claim 19, at column 8, line 51, please insert -- a -- after "that".

In the Claims, claim 19, at column 8, line 53, please delete "floor" (2nd occurrence) and insert --door-- therefor.

In the Claims, claim 19, at column 8, line 63, please delete "lest" and insert -- least -- therefor.

UNITED STATES PATENT AND TRADEMARK OFFICE

CERTIFICATE OF CORRECTION

PATENT NO. : 5,056,836

DATED : October 15, 1991

INVENTOR(S) : Lewis M. Wells

It is certified that error appears in the above-identified patent and that said Letters Patent is hereby corrected as shown below:

In the Claims, claim 20, at column 8, line 68, please delete "fromsaid" and insert -- from said -- therefor.

In the Claims, claim 20, at column 9, line 2, please delete "fromsaid" and insert -- from said -- therefor.

In the Claims, claim 20, at column 9, line 2, please delete "ember" and insert -- member -- therefor.

In the Claims, claim 23, at column 9, line 19, please delete "fromsaid" and insert -- from said -- therefor.

In the Claims, claim 30, at column 10, line 21, please delete "fromsaid" and insert -- from said -- therefor.

Signed and Sealed this

Twenty-fifth Day of May, 1993

*Attest:*

Michael K. Kirk

MICHAEL K. KIRK

*Attesting Officer*

*Acting Commissioner of Patents and Trademarks*